US010179996B2

(12) United States Patent
Schluter

(10) Patent No.: US 10,179,996 B2
(45) Date of Patent: Jan. 15, 2019

(54) FAçADE STRUCTURE

(71) Applicant: Schluter Systems L.P., Plattsburgh, NY (US)

(72) Inventor: Werner Schluter, Iserlohn (DE)

(73) Assignee: Schluter Systems L.P., Plattsburgh, NY (US)

( * ) Notice: Subject to any disclaimer, the term of this patent is extended or adjusted under 35 U.S.C. 154(b) by 0 days.

(21) Appl. No.: 15/967,908

(22) Filed: May 1, 2018

(65) Prior Publication Data

US 2018/0245342 A1 Aug. 30, 2018

Related U.S. Application Data

(62) Division of application No. 14/868,063, filed on Sep. 28, 2015, now Pat. No. 9,988,814.

(30) Foreign Application Priority Data

Oct. 6, 2014 (DE) ..... 20 2014 104 772 U

(51) Int. Cl.

| | |
|---|---|
| ***E04B 5/17*** | (2006.01) |
| ***E04F 13/08*** | (2006.01) |
| ***E04B 5/48*** | (2006.01) |
| ***E04B 1/74*** | (2006.01) |

(Continued)

(52) U.S. Cl.

CPC ..... *E04B 5/17* (2013.01); *E04B 1/625* (2013.01); *E04B 1/6801* (2013.01); *E04B 1/6803* (2013.01); *E04B 1/74* (2013.01); *E04B 5/48* (2013.01); *E04F 13/0875* (2013.01); *E04F 13/0885* (2013.01)

(58) Field of Classification Search

CPC . E04B 5/17; E04B 1/74; E04B 1/6803; E04B 1/625; E04B 1/6801; E04B 5/48; E04F 13/0875; E04F 13/0885

USPC ..... 52/384, 385, 390, 386, 387, 388, 389

See application file for complete search history.

(56) References Cited

U.S. PATENT DOCUMENTS 1,867,897 A * 7/1932 Stanbrough ..... E04F 13/0862 52/388
4,783,941 A * 11/1988 Loper ..... E04C 2/384 52/235

(Continued)

FOREIGN PATENT DOCUMENTS

FR 2335664 A1 * 7/1977 ..... E04F 13/0875
JP 04357264 A * 12/1992

*Primary Examiner* — Babajide A Demuren
(74) *Attorney, Agent, or Firm* — Thorpe North & Western, LLP

(57) ABSTRACT

A method for manufacturing a facade structure includes fastening to a load-bearing underground of a facade a dimensionally stable insulating layer having a supporting outer surface. Spacers of the same height are fastened to the insulating layer such that the spacers protrude outward from the insulating layer. An elastic adhesive is applied at points and/or as rows onto the insulating layer and/or the tile elements in areas in which no spacers are disposed, the height of the applied adhesive being greater than the height of the spacers. The tile elements are adhered to the insulating layer by pressing the tile elements against the spacers, whereby hollow spaces remain between the tile elements and the insulating layer due to the point-like and/or rows of applied adhesive.

19 Claims, 3 Drawing Sheets

(51) Int. Cl.
*E04B 1/68* (2006.01)
*E04B 1/62* (2006.01)

(56) References Cited

U.S. PATENT DOCUMENTS 4,841,705 A * 6/1989 Fuhrer ..... E04F 13/04 52/309.13
4,917,933 A * 4/1990 Schluter ..... E04B 1/762 428/107
4,943,185 A * 7/1990 McGuckin ..... E02D 31/02 210/170.07
5,052,161 A * 10/1991 Whitacre ..... E04F 15/18 52/385
5,255,482 A * 10/1993 Whitacre ..... E04F 15/18 52/385
5,383,314 A * 1/1995 Rothberg ..... E02D 31/02 405/43
5,598,673 A * 2/1997 Atkins ..... E04B 1/7046 52/302.1
5,816,005 A * 10/1998 Han ..... A47K 3/008 52/389
5,927,033 A * 7/1999 Kreckl ..... E04F 13/0883 156/310
5,956,921 A * 9/1999 Fleck ..... B32B 5/00 428/323
6,151,854 A * 11/2000 Gutjahr ..... E04D 13/0477 52/385
6,434,901 B1 * 8/2002 Schluter ..... E02D 5/801 52/302.1
6,691,472 B2 * 2/2004 Hubert ..... E02D 31/02 405/107
D541,396 S 4/2007 Fawcett et al.
D587,358 S 2/2009 Stephan et al.
7,596,918 B2 * 10/2009 Hills ..... E04B 2/8635 52/333
7,919,729 B2 4/2011 Hsu
8,020,783 B2 9/2011 Backman, Jr.
8,288,689 B1 10/2012 Adelman
8,695,300 B2 * 4/2014 Hartl ..... E04F 15/18 52/302.1
8,980,426 B2 * 3/2015 Farrage, Jr. ..... E04F 13/0862 428/343
2006/0096208 A1 * 5/2006 Turner ..... E04F 15/02183 52/389
2006/0201092 A1 * 9/2006 Saathoff ..... E04F 13/00 52/385
2006/0260233 A1 * 11/2006 Schluter ..... E04F 15/18 52/302.3
2014/0097169 A1 4/2014 Charron

* cited by examiner

FAçADE STRUCTURE

PRIORITY

This is a divisional application of U.S. patent application Ser. No. 14/868,063, filed Sep. 28, 2015, which claims priority to German utility model application number 20 2014 104 772.7, filed Oct. 6, 2014, each of which is hereby incorporated herein by reference in its entirety.

FIELD OF THE INVENTION

The present invention relates generally façade structures and related methods that include an outside skin of tile coverings.

BACKGROUND OF THE INVENTION

Facade structures of the type mentioned above are known in the prior art in a wide variety of embodiments. To produce the insulating layer used to provide thermal insulating, rectangular insulating panels with a flat, supporting outer surface are glued to a load-bearing underground, such as the outside wall of a building, using lumps of mortar or by applying a tile adhesive to the entire surface. Then, the tile covering is mounted to the outside of the insulating layer, the covering providing rain protection and protecting against other atmospheric effects and against mechanical damages, and providing an exterior design.

According to a first variant in the prior art, the installation of the tile covering first involves the application of a reinforced inner wall onto the insulating layer, the inner wall normally having a total thickness of between 25 and 35 mm. Then, the tile elements can be glued to the inner wall using a cement-like tile adhesive. Alternatively, a decoupling mat can first be attached to the inner wall using a cement-like tile adhesive, the mat also being additionally securable using dowels, whereupon the tile elements are glued to the decoupling mat. The purpose of the decoupling mat is to prevent the transfer of stresses from the inner wall to the tile elements or from the tile elements to the inner wall. A disadvantage of this variant is first of all that the application of the reinforced inner wall is time- and cost-intensive. Furthermore, plastics and calcium carbonate can bleed out from the tile adhesive, which leads to visually unpleasant deposits. Also, according to DIN 18515-1, which applies to mortared tiles or tiles with a surface area of $\leq 0.12\ m^2$, a side length of $\leq 0.40$ m and a thickness of $\leq 0.015$ m, tile elements with format sizes of more than 30×40 cm may not be used, at least nominally.

In an alternative variant of the prior art, the tile covering is mounted using metal support systems that are dowelled to the load-bearing underground of the facade structure, wherein the individual tile elements are fixed to the support system by way of special anchors. An advantage of such support systems is that they can be installed at a predetermined distance from the insulating layer so that the tile covering is ventilated from behind. However, there is a disadvantage in that the tile elements have to be relatively thick if the anchors are to engage in slots or holes made in the side edges or on the back side of the tile elements, as seen in publication DE 40 04 103 A1, for example. For thinner tile elements, support brackets are normally used, but they reach around the surface of the tile elements that are visible from the outside, negatively affecting the appearance of the facade structure. Another disadvantage is that the joints between adjacent tile elements remain open in these types of support systems so that rainwater, for example, can get behind the tile covering. Also, open joints are not always desirable when it comes to visual appearances. Moreover, the insulating layer is interrupted by the anchoring of the support structures at the load-bearing underground of the facade structure, which leads to undesirable thermal bridges. Lastly, such support systems are very cost-intensive.

SUMMARY OF THE INVENTION

In accordance with one aspect of the invention, insulating sheets, rolls or panels are provided with a fabric or fleece coating on the front side and/or back side thereof. Such a fabric or fleece is advantageous in that an adhesive or mortar for fastening the insulating panels to the load-bearing underground of the facade structure can cling very well to the fabric or fleece, resulting in a very stable attachment of the insulating panels.

The insulating sheets, rolls or panels can be provided with a vapour barrier on the front side and/or back side thereof. Such a reinforcing and/or sealing layer counteracts any warpage of the insulating panels and/or penetration of moisture or vapour.

It is advantageous that butt joints located between adjacent insulating panels can be sealed water-tight. Also useful for sealing are sealing strips with fleece lamination on both sides. Overall, a fully water-tight insulating layer can be achieved in this way.

The tile elements can be made of ceramic, natural stone, metal, glass or plastic. According to one embodiment of the present invention, the tile elements have outside dimensions of at least 50×50 cm.

It is advantageous for the elastic adhesive that fastens the tile elements to the insulating layer to be a non-cement adhesive so that the bleeding mentioned above is prevented. The adhesive is a polymer-based, silane-modified adhesive in particular. Such an adhesive is particularly suitable for the processing of large-format fleeces having outside dimensions of at least 40×40 cm.

According to one embodiment of the present invention, the spacers are formed by strip-like pads or plates that extend beneath the edge areas of adjacent tile elements and along the joints between said tile elements and are fastened to the insulating layer, and that the joints are filled with joint material. In other words, spacers so designed and placed are not just provided for arranging the tile elements at a predetermined distance from the insulating layer, but they are also used as a base for joining the tile elements, and they limit the amount of joint material needed to fill the joints. The joint material that fills the joints prevents large amounts of rainwater from penetrating into the facade structure. Moreover, the filled joints provide a very appealing visual appearance.

The strip-like pads or plates can be provided with a fabric or a fleece at least on the bottom side thereof. In this way, good back-ventilation of the facade structure is ensured. It is particularly advantageous for two pluralities of criss-crossing fluid channels to be provided, which safely prevents errors in the installation of the spacers from occurring.

It is advantageous that the strip-like pads or plates are provided with depressions in the top sides thereof in the area below the joints, said depressions holding joint material. Such depressions contribute to the attachment of the joint material.

The strip-like pads or plates can be provided with a fabric or a fleece at least on the bottom side thereof in which an adhesive for attaching the strip-like pads or plates to the insulating layer can cling. Moreover, the fabric or fleece prevents the fluid channels from filling with adhesive. The fabric or fleece can be anchored to the bottom of the strip-like pad or plate by way of a suitable adhesive. Alternatively, however, the fabric or fleece can be laminated onto or welded to the material of the strip-like pads or plates during the manufacture thereof. The strip-like pads or plates can have a width in the range of 3 to 10 cm. Such a width combines proper functioning with low cost.

The present invention further provides related methods for manufacturing a facade structure of the above defined type. Such methods can comprise the following steps: a) fastening dimensionally stable insulating panels having flat, supporting outer surfaces at a load-bearing underground of a facade; b) fastening spacers of the same height to the insulating panels such that the spacers protrude outward from the insulating panels; c) applying an elastic adhesive at points and/or as rows onto the insulating panels and/or the tile elements in areas in which no spacers are disposed, wherein the height of the applied adhesive is greater than the height of the spacer; and d) gluing the tile elements to the insulating panels by pressing the tile elements against the spacers, whereby hollow spaces remain between the tile elements and the insulating panels due to the point-like and/or rows of applied adhesive in step c).

The insulating panels are preferred to be attached to the load-bearing underground in step a) using mortar, a thin bed of mortar or an adhesive, in particular a silane-modified, polymer-based adhesive, wherein the mortar, the thin bed of mortar or the adhesive can be applied to the insulating panels and/or the load-bearing underground in points, strips or on the entire surface thereof.

Alternatively or in addition thereto, the insulating panels can be fastened to the load-bearing underground by way of dowels.

According to an embodiment of the present invention, the butt joints that remain between the insulating panels after step a) is carried out are sealed off water-tight at the front of the insulating panels, in particular through the use of spreadable or spatula-applied sealants into which preferably fleece or fabric, or sealing strips provided on both sides with a fleece laminate, are embedded.

The spacers are advantageously fastened to the insulating panels by way of adhesive, which results in a simple attachment.

After step d) is carried out, the joints that remain between the tile elements are advantageously filled with joint material, which results in a facade structure that is closed to the outside.

There has thus been outlined, rather broadly, relatively important features of the invention so that the detailed description thereof that follows may be better understood, and so that the present contribution to the art may be better appreciated. Other features of the present invention will become clearer from the following detailed description of the invention, taken with the accompanying drawings and claims, or may be learned by the practice of the invention.

DETAILED DESCRIPTION

Figure 1:
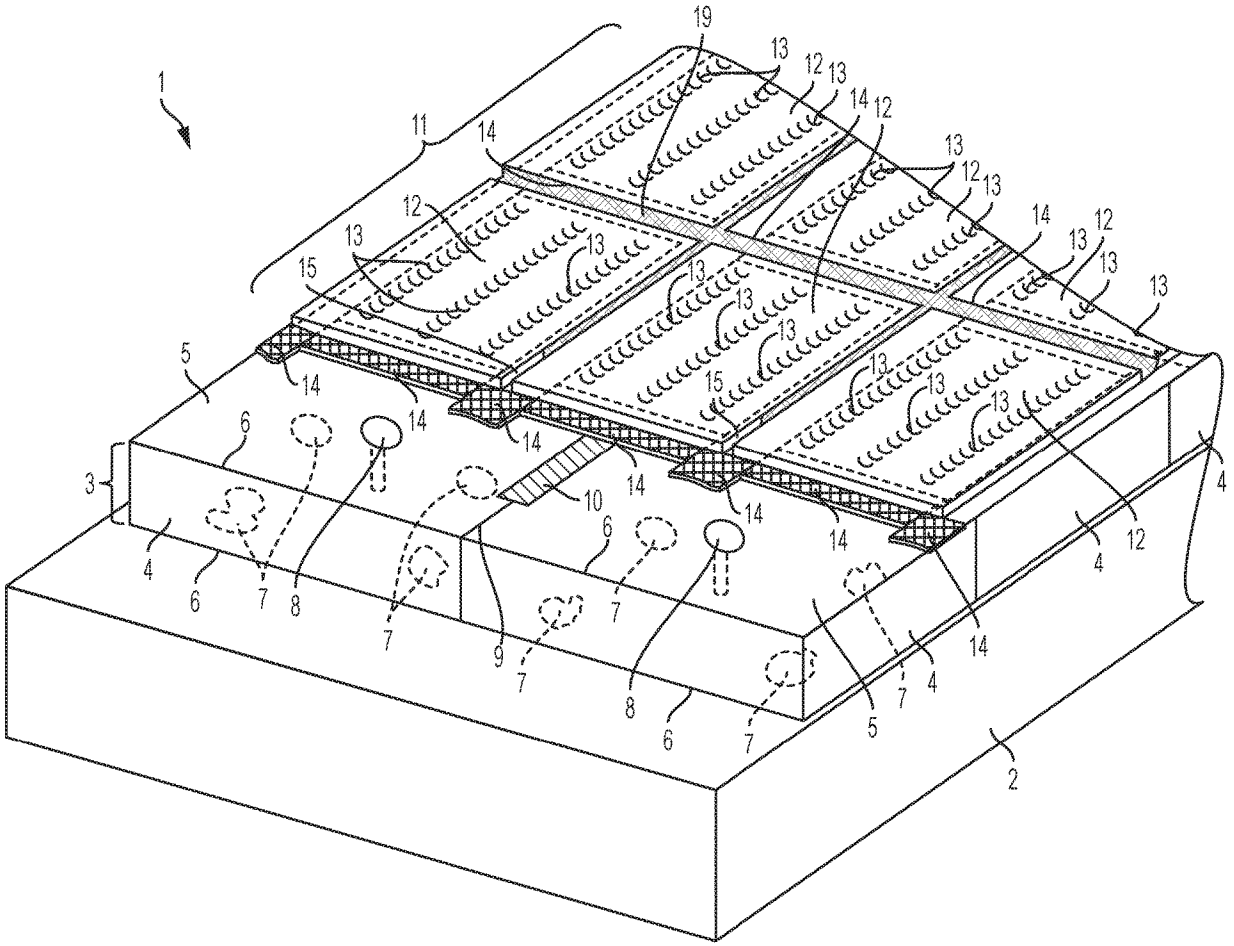
FIG. 1 is a schematic perspective view of a design of a facade structure according to an embodiment of the present invention.

Before the present invention is disclosed and described, it is to be understood that this invention is not limited to the particular structures, process steps, or materials disclosed herein, but is extended to equivalents thereof as would be recognized by those of ordinarily skilled in the relevant arts. It should also be understood that terminology employed herein is used for the purpose of describing particular embodiments only and is not intended to be limiting.

It must be noted that, as used in this specification and the appended claims, the singular forms "a" and "the" include plural referents, unless the context clearly dictates otherwise. Thus, for example, reference to a "tile" can include one or more of such "tiles."

Definitions

In describing and claiming the present invention, the following terminology will be used in accordance with the definitions set forth below.

As used herein, the terms "upper," "lower," "elevation," "height," and the like, are to be understood to refer to relative locations and/or displacements of various elements or components relative to a condition in which a veneer system is oriented in its usable orientation. These terms are used to more clearly claim and describe the various elements or components of the invention and, unless the context clearly indicates otherwise, are not to be construed as limiting the invention to any particular embodiment.

As used herein, the term "substantially" refers to the complete or nearly complete extent or degree of an action, characteristic, property, state, structure, item, or result. As an arbitrary example, an object that is "substantially" enclosed is an object that is either completely enclosed or nearly completely enclosed. The exact allowable degree of deviation from absolute completeness may in some cases depend on the specific context. However, generally speaking the nearness of completion will be so as to have the same overall result as if absolute and total completion were obtained.

The use of "substantially" is equally applicable when used in a negative connotation to refer to the complete or near complete lack of an action, characteristic, property, state, structure, item, or result. As an arbitrary example, a composition that is "substantially free of" particles would either completely lack particles, or so nearly completely lack particles that the effect would be the same as if it completely lacked particles. In other words, a composition that is "substantially free of" an ingredient or element may still actually contain such item as long as there is no measurable effect thereof.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually. This same principle applies to ranges reciting only one numerical value as a minimum or a maximum. Furthermore, such an interpretation should apply regardless of the breadth of the range or the characteristics being described.

Invention

The present invention relates to a facade structure, comprising a load-bearing underground, an insulating layer attached to the load-bearing underground, the insulating layer comprising dimensionally-stable insulating panels with flat, supporting outer surfaces, and a tile covering comprising a plurality of tile elements fastened to the insulating layer by way of an adhesive, the tile covering forming the outside skin of the facade structure. The present invention further relates to a method for manufacturing related facade structures.

The present invention provides a facade structure of the type mentioned above characterized, in one embodiment, in that adhesive is designed to be elastic and is applied to the tile elements and/or the insulating layer in point or row-like fashion, and that spacers are disposed between the tile elements and the insulating layer, said spacers defining hollow interconnected spaces between the individual tile elements and the insulating layer. An important advantage of the facade structure according to the invention is that the tile elements are fastened directly to the insulating layer without the use of an additional support system, whereby there is no need for a reinforced inner wall, which results in a very simple and cost-effective design. Further, a decoupling is effected between the insulating layer and the tile elements by way of the flexible adhesive. The use of spacers also achieves good back ventilation of the tile covering.

Figure 2:
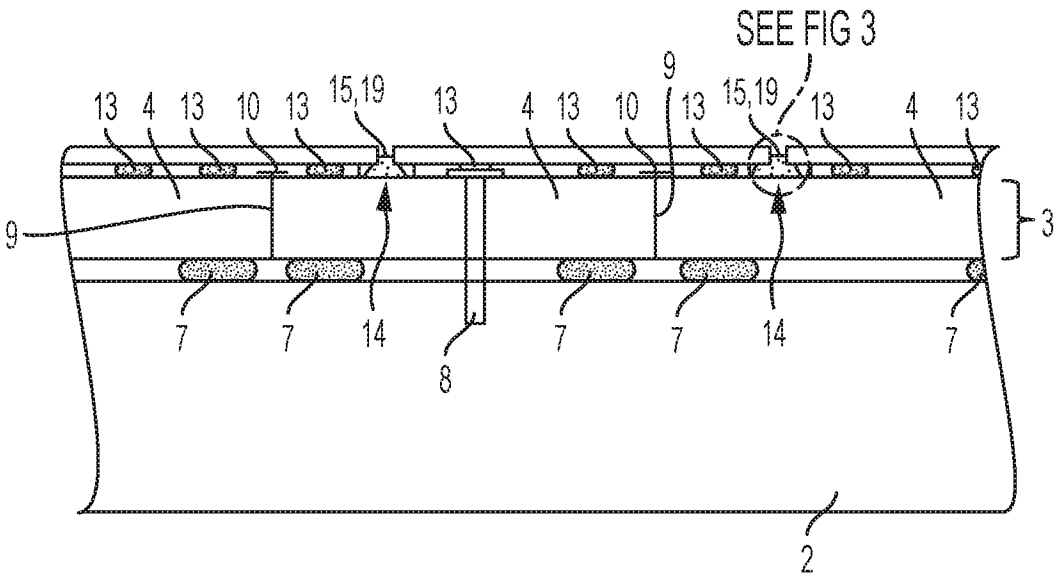
FIG. 2 is a schematic cross-sectional view of the design shown in FIG. 1.
Figure 3:
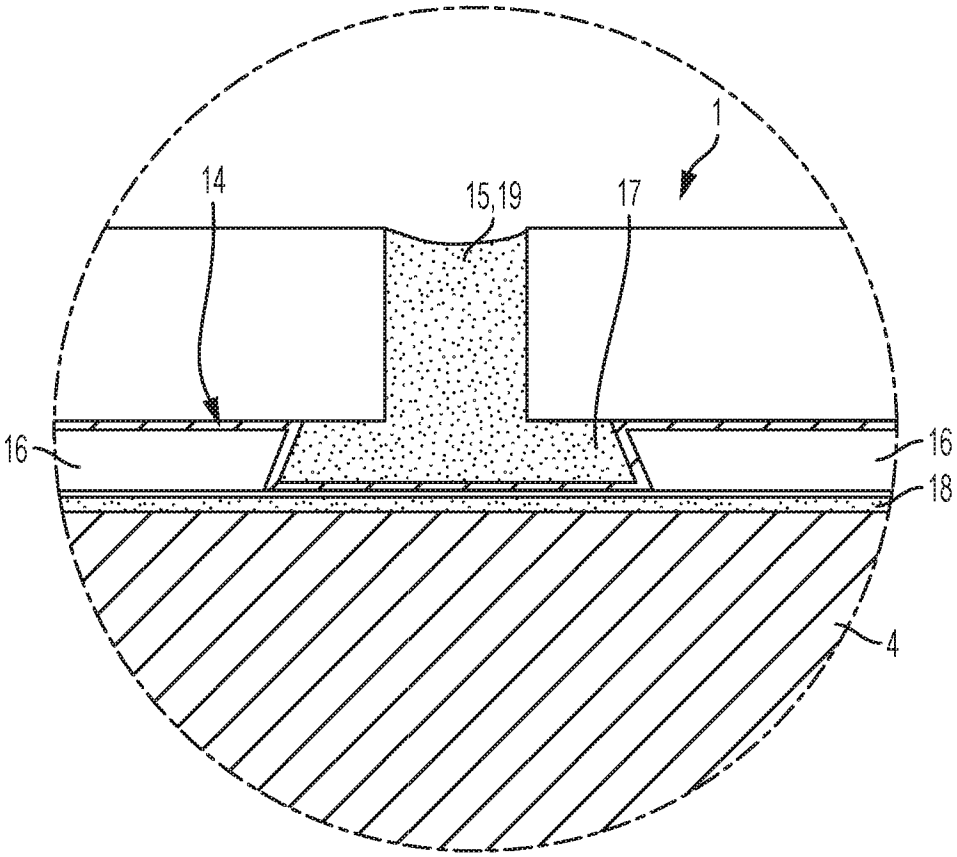
FIG. 3 is an enlarged view of the section identified in FIG. 2 by the reference sign III.

FIGS. 1 through 3 show a design of a facade structure 1 according to one embodiment of the present invention. The facade structure 1 comprises a load-bearing underground 2 that in this case consists of brickwork. Alternatively, the base 2 can also contain concrete, metal, wood or the like. The load-bearing underground 2 is normally vertical, even though it is shown in the horizontal position in FIG. 1.

The facade structure 1 further comprises an insulating layer 3 fastened to the load-bearing underground 2, the tile consisting of a plurality of dimensionally-stable insulating panels 4 with flat, supporting outer surfaces 5. The insulating panels 4, which are made of mineral fibres, polystyrene foam or some other suitable insulating material, for example, comprise a fleece coating 6 on the front side thereof, which forms the outer surface 5, and on the back side opposite thereto. The opposing fleece coatings 6 act as an adhesion base for an adhesive or mortar. Instead of the fleece coatings 6, fabric coatings can be provided as an alternative. Further, a reinforcing and/or sealing layer can be disposed below each fleece coating 6, even though this is not shown in this case, the layer optionally comprising a layer of paper and/or plastic and/or a metallic layer, for example an aluminium foil layer. Such a reinforcing and/or sealing layer counteracts any warpage of the insulating panels 4 and/or penetration of moisture or vapour. The insulating panels 4 are each fastened to the load-bearing underground 2 using a mortar, the mortar being evenly distributed in the form of mortar lumps 7 onto the back of the insulating panels 4. Instead of the mortar, the entire surface can be adhered using a tile adhesive or the like. For smooth bases, such as metal or wood, it is preferred for a silane-modified, polymer-based adhesive to be used to fasten the insulating panels 4, the adhesive being applied to the insulating panels 4 or load-bearing underground 2 in the form of separate rows of adhesive at a distance from one another. In addition, the insulating panels 4 are fastened to the load-bearing underground 2 by way of disc-shaped dowels 8. The butt joints 9 between the individual insulating panels 4 that remain at the front side are sealed water-tight using a sealing means 10, wherein the sealing means 10 is made up to a spreadable or spatula-applied sealant in which a fleece or fabric strip or sealing strip with fleece laminated on both sides is embedded. However, the sealing means 10 can also be of a different design altogether.

The facade structure 1 further comprises a tile covering 11 with a plurality of tile elements 12 and which forms the outer skin of the facade structure. The tile elements 12 are in this case large-format ceramic tiles with outer dimensions of 50×50 cm or more and a thickness in the range of 0.5-2.0 cm. Alternatively, however, tile elements in the form of natural stone tiles, metal tiles, glass tiles or plastic tiles can also be used. In addition, the tile elements 12 can also have other dimensions. The tile elements 12 are fastened to the insulating layer 3 using an elastic adhesive 13, which in this case is a cement-free adhesive, more precisely a silane-modified, polymer-based adhesive, wherein the elastic adhesive 13 is applied to the back sides off the tile elements 12 in the form of a plurality of individual rows. Alternatively, a point-like application of adhesive is also possible.

Spacers 14 extend between the tile elements 12 and the insulating layer 3, the spacers in this case being formed by strip-like pads or plates with a thickness in the range of 3 to 10 cm and glued to the insulating layer 3 and each extending below the edge areas of adjacent tiles elements 12 and along the joints 15 between said tile elements 12. The strip-like pads or plates each comprise two pluralities of criss-crossing fluid channels 16. More precisely, these pads or plates consist of a plastic film with rectangular, square or rounded depressions 17 extending out from the front side, the depressions being disposed in regularly distributed fashion and with the fluid channels 16 being located therebetween. The back of the strip-like pads or plates is laminated with a fleece 18 that acts as an adhesive base for a mortar or adhesive and that prevents the fluid channels 16 from filling. However, a fabric can be provided instead of the fleece 18. The spacers 14 maintain the tile elements 12 that sit on the fleece or fabric at a defined distance relative to the insulating layer 3. The fluid channels 16 of the spacers 14 ensure that the hollow spaces remaining between the tile elements 12 and the insulating layer 3 are connected fluid-dynamically with one another. Joints 15 between the tile elements 12 are filled with joint material 19.

To install the facade structure 1, the dimensionally stable insulating panels 4 are fastened to the load-bearing underground 2 of the facade structure 1 in a first step. To this end, in a first step the mortar lumps 7 are applied to the back sides of the insulating panels 4, whereupon the insulating panels 4 are manually pressed onto the load-bearing underground 2.

In a second step, the insulating panels 4 are additionally secured to the load-bearing underground 2 by way of the disc-shaped dowels 8.

Then, the butt joints remaining between the insulating panels 4 are sealed water-tight at the front side of the insulating panels 4. To this end, a first layer of a spreadable or spatula-applied sealant is applied to the butt joints 9. Then, a sealing strip provided on both sides with a fleece laminate is placed onto the sealant just applied. Thereafter, a second layer of the spreadable or spatula-applied sealant is applied to the sealing strip. In this way, the insulating layer 3 is sealed water-tight.

Now, the spacers 14 are glued to the insulating layer 3 in a substantially grid-like fashion using a suitable adhesive along the joints 15 that form later between the tile elements.

In another step, the elastic adhesive 13 is applied in rows to the back sides of the tile elements 12 and/or to the insulating layer 3 in areas in which in the finished installed state of the tile elements 12 no spacers 14 are located. The height of the adhesive applied in this case is selected to be greater than the height of the spacers 14. It is preferred for the height of the adhesive applied to be at least about twice as great as the height of the spacers 14.

Then, the tile elements 12 are glued to the insulating panels 4 of the insulating layer 3 by pressing the tile elements 12 against the spacers 14 until they sit against the spacers. Due to the row-like application of adhesive, hollow interconnected spaces remain between the tile elements 12 and the insulating layer 3, wherein the interconnection is realized by way of the fluid channels 16 of the spacers 14.

In a last step, the joints 15 between the tile elements 12 are filled with joint material 19. In the process, the joint material 19 also fills the depressions 17 of the spacers 14, resulting in a secure hold by the joint material 19. The joints 15 can also be designed as expansion joints disposed at regular intervals. To this end, elastic joint material can be used. Alternatively, commercially-available expansion joint profiles can be used.

The facade structure 1 described above has an easy-to-manufacture and cost-effective design. Moreover, the facade structure 1 is well ventilated in back thanks to the hollow spaces that form between the tile elements 12 and the insulating layer and that are connected with one another fluid-dynamically by way of the fluid channels 16 of the spacers 14. In addition, water that penetrates through the hollow spaces into the facade structure 1 can be easily drained out by way of the insulating layer 3 through the hollow spaces and through the fluid channels 16 that are designed into the spacers 14. The joints 15 present between the tile elements 12 are filled with joint material 19, resulting in a very visually appealing appearance. The fastening of the tile elements 12 using a row of applied elastic adhesive is advantageous for one thing in that the tile elements 12 are decoupled from the insulating layer 3 stress-wise. For another thing, no bleeding occurs thanks to the use of a cement-free adhesive. Moreover, the elastic adhesive is also suitable for fastening large-format tile elements 12, in other words tile elements with outside dimensions of 50×50 cm and more. As such, the facade structure 1 can be very flexibly designed.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements. Thus, while the present invention has been described above with particularity and detail in connection with what is presently deemed to be the most practical and preferred embodiments of the invention, it will be apparent to those of ordinary skill in the art that numerous modifications, including, but not limited to, variations in size, materials, shape, form, function and manner of operation, assembly and use may be made without departing from the principles and concepts set forth herein.

LIST OF PARTS

1 Facade structure
2 Load-bearing underground
3 Insulating layer
4 Insulating tile
5 Outer surface
6 Fleece layer
7 Mortar lumps
8 Disc-like dowel
9 Butt joint
10 Sealing means
11 Tile covering
12 Tile element
13 Elastic adhesive
14 Spacer
15 Joint
16 Fluid channel
17 Depression
18 Fleece
19 Joint material

What is claimed is:

1. A method for manufacturing a facade structure, comprising:

fastening to a load-bearing underground of a facade an insulating layer having a supporting outer surface;

fastening spacers of substantially the same height to the insulating layer such that the spacers protrude outward from the insulating layer;

applying an adhesive at points and/or as rows onto the insulating layer and/or the tile elements in areas in which no spacers are disposed, the height of the applied adhesive being greater than the height of the spacers; and adhering tile elements to the insulating layer by pressing the tile elements against the spacers, whereby hollow spaces remain between the tile elements and the insulating layer due to the points and/or rows of applied adhesive.

2. A method according to claim 1, wherein the insulating layer is attached to the load-bearing underground using mortar, a thin bed of mortar or an adhesive, wherein the mortar, the thin bed of mortar or the adhesive is applied to the insulating layer and/or the load-bearing underground in points, strips or on the entire surface thereof.

3. A method according to claim 1, wherein the insulating layer is fastened to the load-bearing underground by way of dowels.

4. A method according to claim 1, wherein the insulating layer is formed of a series of insulating panels or sheets, and wherein butt joints that remain between the insulating panels or sheets are sealed off water-tight at the front of the insulating layer through the use of spreadable or spatula-applied sealants into which fleece or fabric, or sealing strips provided on both sides with a fleece laminate, are embedded.

5. A method according to claim 1, wherein the spacers are fastened to the insulating layer by way of adhesive.

6. A method according to claim 1, wherein joints that remain between the tile elements are filled with joint material.

7. A method according to claim 1, wherein the insulating layer is provided with a fabric or fleece coating on the front side and/or back side thereof.

8. A method according to claim 1, wherein the insulating layer is provided with a vapour barrier on the front side and/or back side thereof.

9. A method according to claim 1, wherein the spacers are formed by pads or plates that extend beneath the edge areas of adjacent tile elements and along the joints between said tile elements and are fastened to the insulating layer, and that the joints are filled with joint material.

10. A method according to claim 9, wherein each of the pads or plates comprises a plurality of fluid channels that extend in at least one direction, said channels interconnecting hollow spaces present between the tile elements and the insulating layer.

11. A method according to claim 9, wherein the pads or plates are provided with depressions in the top sides thereof in the area below the joints, said depressions holding joint material applied between adjacent tiles.

12. A method for manufacturing a facade structure, comprising:

fastening to a load-bearing underground of a facade an insulating layer having a supporting outer surface;

fastening spacers of substantially the same height to the insulating layer such that the spacers protrude outward from the insulating layer;

applying an adhesive onto the insulating layer and/or the tile elements in areas in which no spacers are disposed, the height of the applied adhesive being greater than the height of the spacers; and adhering the tile elements to the insulating layer by pressing the tile elements against the spacers, whereby hollow spaces remain between the tile elements and the insulating layer adjacent the applied adhesive.

13. A method according to claim 12, wherein applying the adhesive comprises applying the adhesive at points and/or as rows onto the insulating layer and/or the tile elements in areas in which no spacers are disposed.

14. A method according to claim 12, wherein the spacers are fastened to the insulating layer by way of adhesive.

15. A method according to claim 12, wherein the insulating layer is provided with a fabric or fleece coating on the front side and/or back side thereof.

16. A method according to claim 12, wherein the insulating layer is provided with a vapour barrier on the front side and/or back side thereof.

17. A method according to claim 12, wherein the spacers are formed by pads or plates that extend beneath the edge areas of adjacent tile elements and along the joints between said tile elements and are fastened to the insulating layer, and that the joints are filled with joint material.

18. A method according to claim 17, wherein each of the pads or plates comprises a plurality of fluid channels that extend in at least one direction, said channels interconnecting hollow spaces present between the tile elements and the insulating layer.

19. A method according to claim 17, wherein the pads or plates are provided with depressions in the top sides thereof in the area below the joints, said depressions holding joint material applied between adjacent tiles.

* * * * *